United States Patent [19]

Ito et al.

[11] Patent Number: 4,919,634

[45] Date of Patent: Apr. 24, 1990

[54] METHOD OF FABRICATING ELECTRODE OF COLOR PICTURE TUBE ELECTRON GUN

[75] Inventors: Masahiro Ito, Chiba; Satoru Endo, Mobara, both of Japan

[73] Assignee: Hitachi, Ltd., Tokyo, Japan

[21] Appl. No.: 352,607

[22] Filed: May 15, 1989

Related U.S. Application Data

[63] Continuation of Ser. No. 94,698, Sep. 9, 1987, abandoned.

[30] Foreign Application Priority Data

Sep. 12, 1986 [JP] Japan ..... 61-213838

[51] Int. Cl.[5] ..... H01J 9/02

[52] U.S. Cl. ..... 445/49

[58] Field of Search ..... 445/49; 29/DIG. 37

[56] References Cited

U.S. PATENT DOCUMENTS 4,366,414 12/1982 Hatayama et al. ..... 445/49 X
4,645,469 2/1987 Collins et al. ..... 445/49

FOREIGN PATENT DOCUMENTS 4550 3/1965 Japan .
21832 2/1980 Japan ..... 445/49
48301 1/1983 Japan ..... 445/49
157936 9/1984 Japan .

*Primary Examiner*—Kenneth J. Ramsey
*Attorney, Agent, or Firm*—Antonelli, Terry & Wands

[57] ABSTRACT

A method of fabricating an electrode of a color picture tube electron gun, the electrode having an aperture for passing an electron beam and having a recess formed in a surface of a single metal plate, comprises the steps of forming in the metal plate a laterally elongated through hole being substantially symmetrical with the axis of the electron beam pass aperture and having a major diameter in a longitudinal direction of the recess, before the recess is formed, forming the recess at a peripheral wall area of the laterally elongated through hole through a coining process, and forming the electron beam pass aperture by removing a wall portion of the through hole existing after completion of the coining process to form a through hole of a predetermined shape.

20 Claims, 6 Drawing Sheets

METHOD OF FABRICATING ELECTRODE OF COLOR PICTURE TUBE ELECTRON GUN

This application is a continuation of application Ser. No. 094,698, filed on Sept. 9, 1987, now abandoned.

BACKGROUND OF THE INVENTION

This invention relates to fabrication of an electrode of an electron gun and more particularly to a method of fabricating an electrode of a color picture tube electron gun, the electrode having an electron beam pass aperture and a recess surrounding the aperture.

As shown in FIG. 1, a color picture tube 1 comprises a phosphor screen 2, an electron gun 3 and a deflection coil 5. An electron beam emitted from the electron gun 3 passes through one of apertures formed in a color selective electrode 4 and impinges upon the phosphor screen 2.

Incidentally, when an electron beam emitted from the electron gun 3 is deflected toward the periphery of the screen, it undergoes distortion, so that a resulting beam spot is laterally elongated, accompanied with a halo, and focusing at the periphery of the screen tends to be degraded. Especially where the size of the screen is increased, this phenomenon will be aggravated.

To cope with the phenomenon, an expedient has been known wherein a grid electrode, for example, a second grid electrode 10 as shown in FIG. 2 is formed with a recess at a peripheral wall area of an electron beam pass aperture 18, as illustrated in FIGS. 3A and 3B. It will be appreciated herein that FIG. 2 illustrates an electron gun 3 of an in-line type color picture tube and FIGS. 3A and 3B diagrammatically detail the construction of the second grid electrode 10 used in this type of electron gun. The electron gun 3 shown in FIG. 2 comprises, in addition to the second grid electrode 10, cathodes 6, 6' and 6'', a first grid electrode 9, a third grid electrode designated at 11 and 12, a fourth grid electrode 13, and bead glass members 8 for holding these electrodes.

The recess thus formed in the grid electrode to surround the electron beam pass aperture can advantageously change the shape of an electron beam such that the electron beam can be focused uniformly over the entire screen to provide a uniform beam spot. This type of electrode is disclosed in, for example, U.S. Pat. No. 4,366,414 (JP-A-59-157936).

For formation of the recess 16, a coining process utilizing a press is generally used and this technique is disclosed in, for examaple, Japanese Patent Publication No. 40-4550.

When forming the electrode 10 shown in FIGS. 3A and 3B, a substantially circular through hole 14 is typically formed in an electrode plate as shown in FIG. 4A in advance of coining with the aim of mitigating force necessary for coining, as taught from the aforementioned Japanese Patent Publication No. 40-4550. Subsequently, as shown in FIG. 4B, a recess is formed at a peripheral wall area of the through hole 14 through a coining process. Thereafter, as shown in FIG. 4C, a predetermined electron beam pass aperture 18 is formed substantially at the center of a through hole 15.

In the above prior art, however, the through hole 14 is deformed into the through hole 15 which is extremely elongated in the longitudinal direction as shown in FIG. 4B when the recess 16 is formed through the coining process. Consequently, there arises a problem that the predetermined electron beam pass aperture 18 can not be formed without accompanied with bulges 18'.

With a smaller through hole 14, a beam pass aperture 18 devoid of bulge 18' may be formed. But the smaller the through hole 14, the more the working force mitigation effect and the life of a coining tool are lessened.

SUMMARY OF THE INVENTION

An object of this invention is to provide an electron gun electrode fabrication method capable of preventing the occurrence of bulges during the formation of an electron beam pass aperture, mitigating the working force and prolonging the life of the coining tool.

According to the present invention, to accomplish the above object, a laterally elongated through hole having a major diameter in a longitudinal direction of a recess is formed in an electrode plate and the recess is then formed at a peripheral wall area of the through hole through a coining process, and thereafter a predetermined electron beam pass aperture is formed at the through hole.

Advantageously, the laterally elongated through hole can be constricted mainly along the major diameter by coining to take an approximately circular shape devoid of bulge after completion of the coining process. In addition, the laterally elongated through hole can have a larger opening than that of the circular through hole and can be effective to mitigate the coining force and prolong the life of the coining tool.

DESCRIPTION OF THE PREFERRED EMBODIMENT

A method of fabricating an electrode of an electron gun according to an embodiment of the invention will now be described with reference to FIGS. 5A to 5C, FIGS. 6A to 6E and FIG. 7.

Figure 1:
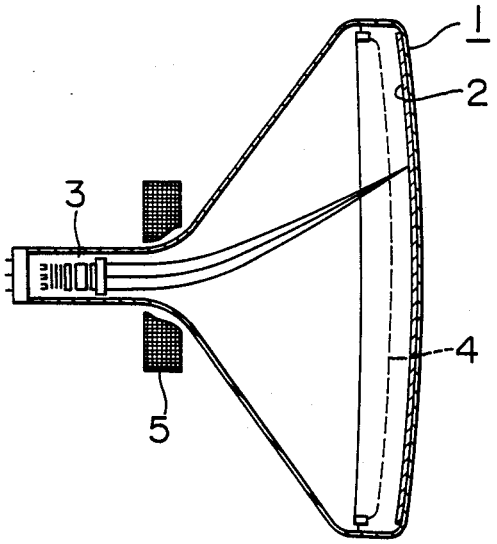
FIG. 1 PRIOR ART
FIG. 1 is a sectional view showing a picture tube of color television.
Figure 2:
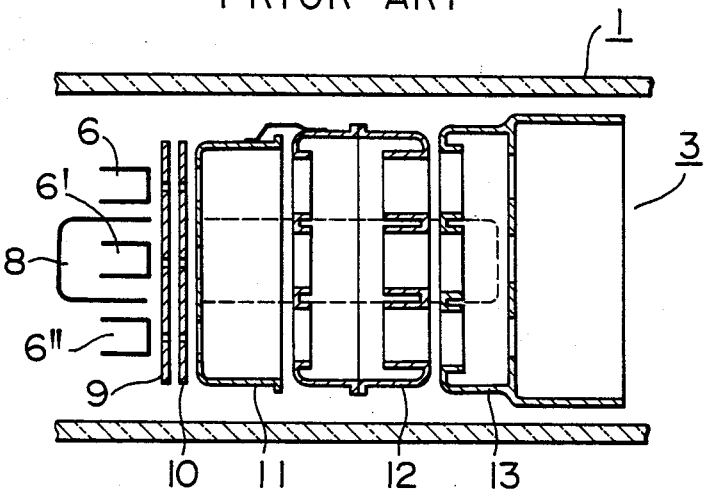
FIG. 2 PRIOR ART
FIG. 2 is a fragmentary sectional view showing an electron gun of the color picture tube.
Figure 3A:
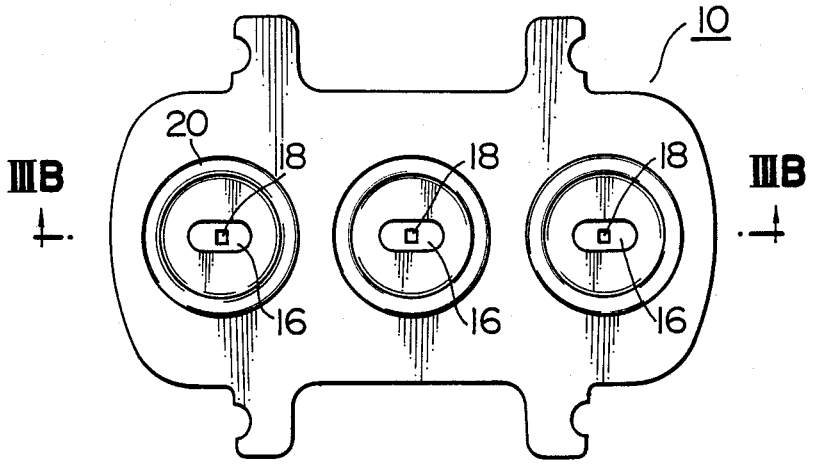
FIG. 3A PRIOR ART
FIG. 3A is a plan view illustrating a grid electrode of the electron gun.
Figure 3B:
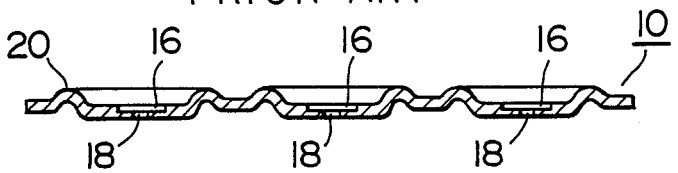
FIG. 3B PRIOR ART
FIG. 3B is a sectional view taken on the line III-B—IIIB of FIG. 3A.
Figure 4A:
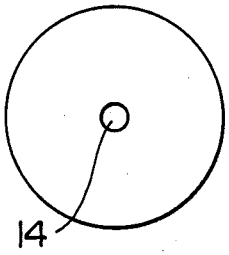
FIG. 4A PRIOR ART
FIGS. 4A, 4B and 4c are diagrams for explaining a prior art fabrication method of an electrode of the electron gun.
Figure 4B:
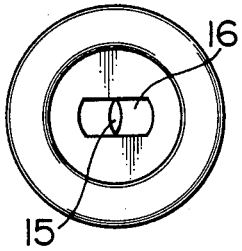
FIG. 4B PRIOR ART
Figure 4C:
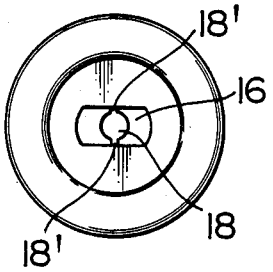
FIG. 4C PRIOR ART

This embodiment will be described by way of formation of electron beam pass apertures 18 in a grid electrode, for example, the second grid electrode 10 of the electron gun of the in-line type color picture tube as shown in FIGS. 3A and 3B.

Figure 5A:
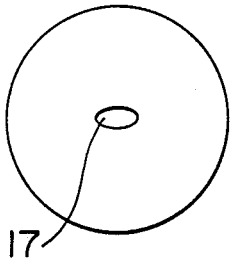
FIGS. 5A, 5B and 5C are diagrams for explaining a fabrication method of an electron gun electrode according to an embodiment of the invention.

Firstly, as shown in FIG. 5A, a laterally elongated through hole 17 having a major diameter in a longitudinal direction of a recess is formed in an electrode plate.

The laterally elongated through hole 17 may take the shape of an ellipse as exemplified in FIG. 5A or of a rectangle. The through hole 17 is formed in a manner as will be described with reference to FIGS. 6A and 6B.

Figure 6A:
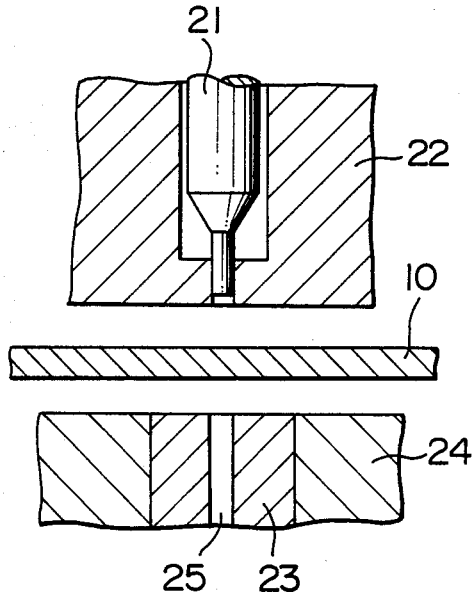
FIGS. 6A to 6G are fragmentary sectional views useful in explaining fabrication steps according to the invention.

FIG. 6A shows a status before the through hole 17 is formed. Three punches 21 (only one is illustrated in the drawing) are supported by an upper holder, not shown, and inserted in a plate setter 22 which is resilently supported by a spring or the like, not shown.

Under a metal thin plate 10, a die 23 is held in a lower holder 24. The die 23 has a blow-off hole 25.

Figure 6B:
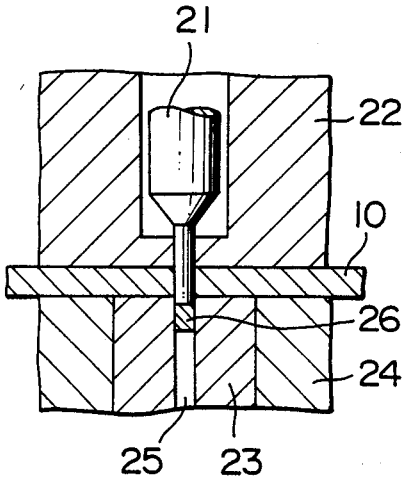

Subsequently, as shown in FIG. 6B, a press (not shown) is lowered to cause the plate setter 22 to push the metal thin plate 10 against the upper surface of the die 23 and the punch 21 is advanced to stamp out a portion 26 of the thin plate 10, thus forming a through hole 17 in the thin plate 10.

Figure 5B:
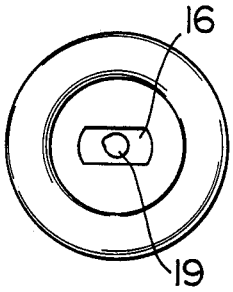
Figure 6C:
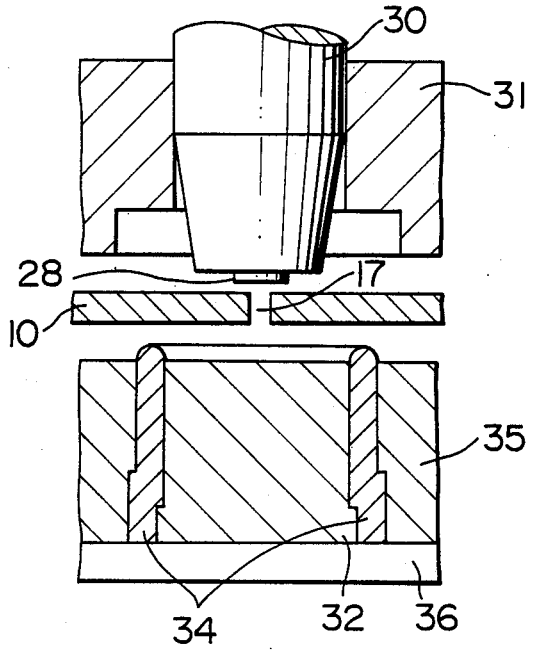
Figure 6D:
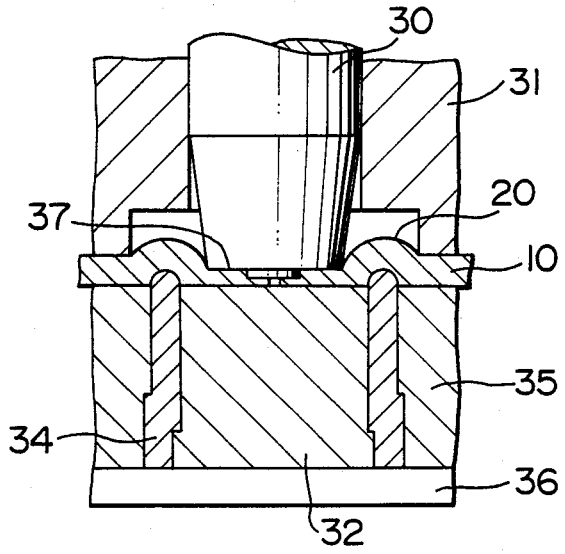

Thereafter, a recess 16 as shown in FIG. 5B is formed through coining process. FIG. 6C shows a status before the recess 16 is formed.

Three upper compression tools 30 (only one is illustrated in the drawing) are inserted in an upper holder 31. The compression tool 30 has a raised portion 28 at the force end. On the other hand, a lower compression tool 32 has a punch 34 for forming a beading 20 as shown in FIGS. 3A and 3B. Three compression tools 32 (only one is illustrated in the drawing) each being in combination with the punch 34 are held in a lower holder 35 which is secured to a base 36.

With the above arrangement, when the metal thin plate 10 formed with the through hole 17 is inserted between the upper and lower tools and the upper compression tool 30 is pushed down, the tool 30 hammers a compression working surface 37 to form a beading 20 and a recess 16 corresponding to the raised portion 28.

During this procedure, the through hole 17 is constricted mainly in the longitudinal direction of the recess 16, i.e., along the major diameter of the through hole 17 through coining process so as to be converted into an approximately circular through hole 19.

The thus formed beadings 20 fill the role of maintaining the flatness of the compression working surface and preventing three electron beams from interfering with each other.

Figure 5C:
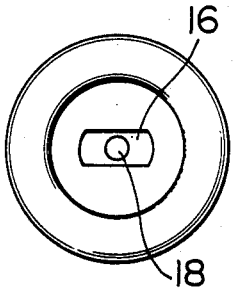

The step of forming the through hole 19 into the electron beam pass aperture 18 as shown in FIG. 5C will now be described with reference to FIGS. 6E to 6G.

Figure 6E:
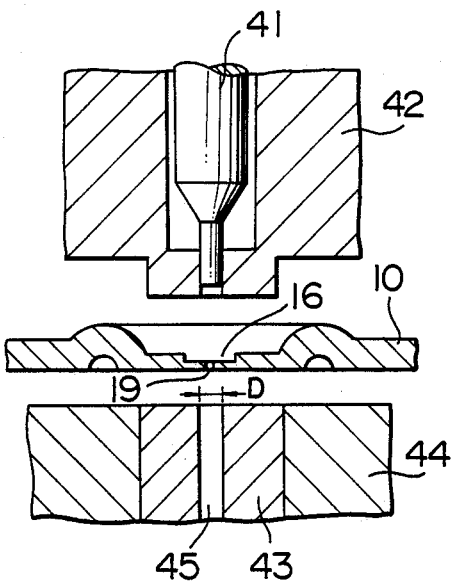

FIG. 6E shows a status before the electron beam pass aperture 18 is formed. Three punches 41 (only one is illustrated in the drawing) are supported by an upper holder, not shown, and a plate setter 42 is resiliently supported by a spring or the like not shown.

A die 43 is held in a lower holder 44. The die 43 has a blow-off hole 45. The diameter of the through hole 19 precedently formed by compression working is so preset as to substantially equal a diameter D of the electron beam pass aperture 18.

Figure 6F:
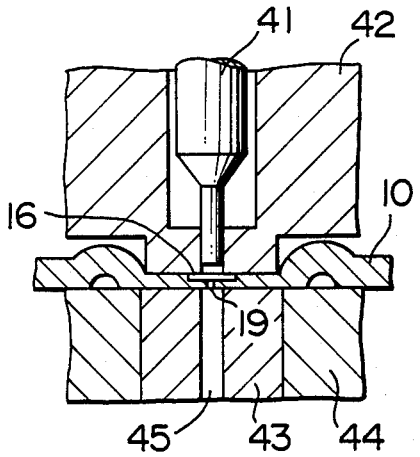
Figure 6G:
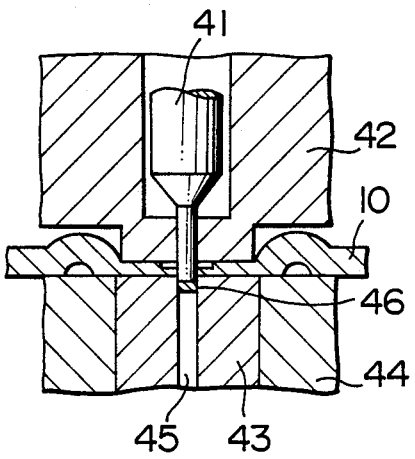
Figure 7:
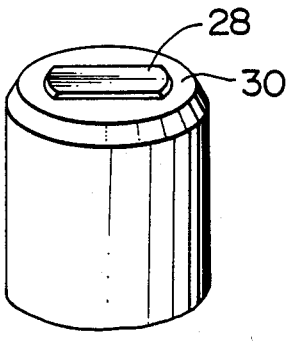
FIG. 7 is a perspective view of a die used for forming a recess in an electrode plate of the electron gun.

Subsequently, as shown in FIG. 6F, a press (not shown) is lowered to cause the plate setter 42 to push the metal thin plate 10 against the upper surface of the die 43 and the punch 41 is advanced to stamp out a portion 46 of the recess 16 in the thin plate 10, thus forming an electron beam pass aperture 18 (FIG. 6G). In this manner, the beam pass aperture 18 is formed at the through hole 19.

Figure 8A:
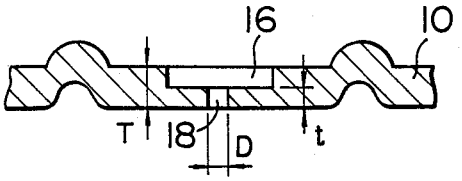
FIG. 8A is a sectional view illustrating an example of an electron gun electrode fabricated according to the invention.
Figure 8B:
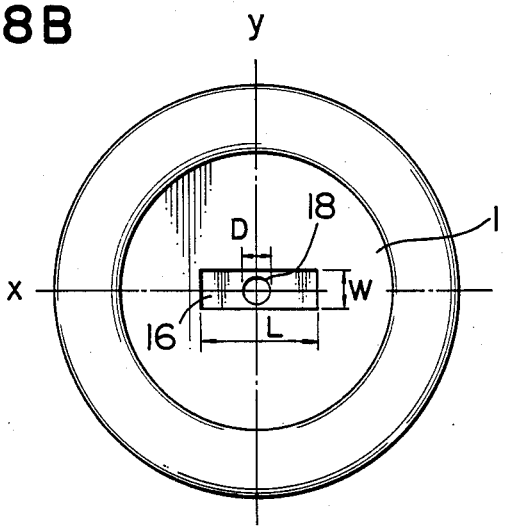
FIGS. 8B and 8C are plan views showing the electron gun electrode of FIG. 8A.
Figure 8C:
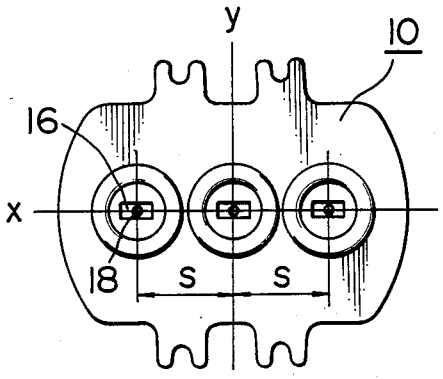

The thus fabricated grid electrode has structural dimensions as will be described with reference to FIGS. 8A to 8C. In the present embodiment, in relation to the diameter D of the electron beam pass aperture 18, the electrode plate has an overall thickness T which is set to be (0.4 to 1.0) D and a thickness t at the recess 16 which is set to be (0.1 to 0.3) D, while the depth of the recess 16 being made constant.

Since the thickness t at the recess 16 is so small that it measures (0.1 to 0.3) D, the depth of the recess 16 is large. Consequently, the electron beam has a divergent angle which is far larger in the horizontal deflection direction (x direction) than in the vertical deflection direction (y direction), ensuring that a highly precise focusing characteristic can be obtained even in a large-size picture tube having a screen size of 20 inches or more.

Results on a trail product will now be described. When taking a color picture tube of 29 mm neck diameter having a second grid electrode 10 in which three electron beam pass apertures 18 were formed at spacings S (pitches) of 6.6 mm and D was 0.67 mm, very good results were obtained for T=0.30 mm (=0.45D) and t=0.13 mm (=0.2D). When S=5.5 mm and D=0.64 mm, very good results were obtained for T=0.26 mm (0.4D) and t=0.10 mm (=0.15D).

Preferably, a major axis L and a minor axis W of the recess 16 are selected such that $W \approx D$ and $2D \leqq L \leqq 3D$.

In order to prevent the occurence of buldge and mitigate the coining force, the through hole 17 has to be sized suitably as will be described below.

The ratio between major diameter $l_1$ and minor diameter $l_2$ of the through hole 17 may preferably be 1.6:1.0 and the smaller the thickness t (the deeper the depth of the recess 16), the greater the ratio becomes. Accordingly, the ratio between $l_1$ and $l_2$ may preferably fall within a range of 1.4 to 1.8:1. The dimensional relation between through hole 17 and recess 16 may be selected such that $l_1 < L$ and $l_2 < W$, preferably $l_2 \approx 0.75W$.

Since the through hole 19 after completion of the coining process has an approximately circular shape as described previously, the electron beam pass aperture 18 devoid of bulge can be formed in contrast to the prior art. The size of the laterally elongated through hole 17, formed preparatorily, can be set within a range in which the electron beam pass aperture 18 is workable after the coining process, having a sufficiently larger opening than that of the circular through hole. This reduces the coining force and prolongs the life of the coining tool.

Advantageously, a reduction in the coining force can suppress the amount of elastic deformation of the coining tool and improve the flatness of the coining surface.

The shape of the laterally elongated through hole 17 is not limited to the ellipse as shown in FIG. 5A but the through hole 17 may be of a rectangular shape and more generally, may be of any of laterally elongated forms.

While in the foregoing embodiment the recess is formed in the second grid electrode, it may be formed in the first grid electrode.

The method of fabricating an electrode of electron gun according to the invention has been described as applied to the electron gun of the in-line type color picture tube but it may be applied to an electron gun of other types of color picture tube, for example, a delta type color picture tube.

We claim:

1. A method of fabricating an electrode of a color picture tube electron gun, said electrode having an aperture for passing an electron beam and a single focusing recess associated with the aperture and having a predetermined width a depth formed in a surface of a single metal plate, said single focusing recess having a predetermined length extending in a predetermined direction substantially symmetrically with respect to an axis of said electron beam pass aperture comprising the steps of:

forming in said metal plate a laterally elongated through hole of substantially ellipitical configuration being substantially symmetrical with the axis of said electron beam pass aperture and having a major diameter in a longitudinal direction of said recess, before said recess is formed;

forming said single focusing recess at a peripheral wall area of said laterally elongated through hole through a coining process; and forming said electron beam pass aperture by removing a wall portion of said through hole existing after completion of the coining process to form a through hole of a predetermined shape.

2. A fabrication method according to claim 1 wherein said electron is one of first and second grid electrodes.

3. A fabrication method according to claim 1 wherein said color picture tube electron gun is of an in-line type.

4. A fabrication method according to claim 1 wherein the ratio between major and minor diameters of said laterally elongated through hole is 1.2 to 1.8:1.0.

5. A fabrication method according to claim 1 wherein the depth of said recess is constant.

6. A fabrication method according to claim 1 wherein said laterally elongated through hole existing before completion of the coining process has a major diameter which is smaller than a longitudinal length of said recess and a minor diameter which is smaller than a width of said recess.

7. A method of fabricating an electrode of a color picture tube electron gun, said electrode having a plurality of electron beam pass apertures in alignment, and a plurality of focusing recesses, with a single one of the focusing recesses being associated with a single one of the apertures and each having a predetermined width and depth formed in a surface of a single metal plate, each of said focusing recesses having a predetermined length extending in a predetermined direction substantially symmetrically with respect to an axis of said electron beam pass apertures, comprising the steps of:

forming in said metal plate a plurality of laterally elongated through holes having substantially elliptical configurations each being substantially symmetrical with the axis of each of said electron beam pass apertures and each having a major diameter in a longitudinal direction of each of said focusing recesses, before said focusing recesses are formed;

forming each of said focusing recesses at a peripheral wall area of each said laterally elongated through holes through a coining process; and forming each of said electron beam pass apertures by removing a wall portion of each of said through hole existing after completion of the coining process to form a plurality of through holes of a predetermined shape.

8. A fabrication method according to claim 1, wherein said recess has a major axis L and a minor axis W dimensioned with respect to a diameter D of said electron beam pass aperture such that $W \approx D$ and $2D \leqq L \leqq 3D$.

9. A fabrication method according to claim 1, wherein said through hole has a major diameter $l_1$ and a minor diameter $l_2$ dimensioned with respect to a major axis L of said recess and a minor axis W of said recess such that $l_1 < L$ and $l_2 < W$.

10. A fabrication method according to claim 9, wherein $l_2 \approx 0.75W$.

11. A fabrication method according to claim 7, wherein said recess has a major axis L and a minor axis W dimensioned with respect to a diameter D of said electron beam pass aperture such that $W \approx D$ and $2D \leqq L \leqq 3D$.

12. A fabrication method according to claim 7, wherein said through hole has a major diameter $l_1$ and a minor diameter $l_2$ dimensioned with respect to a major axis L of said recess and a minor axis W of said recess such that $l_1 < L$ and $l_2 < W$.

13. A fabrication method according to claim 12, wherein $l_2 \approx 0.75W$.

14. A fabrication method according to claim 7, wherein said electrode is one of first and second grid electrodes.

15. A fabrication method according to claim 7, wherein said color picture tube electron gun is of an in-line type.

16. A fabrication method according to claim 7, wherein the ratio between major and minor diameters of said laterally elongated through hole is 1.2 to 1.8:1.0.

17. A fabrication method according to claim 7, wherein the depth of said recess is constant.

18. A fabrication method according to claim 7, wherein said laterally elongated through hole existing before completion of the coining process has a major diameter which is smaller than a longitudinal length of said recess and a minor diameter which is smaller than a width of said recess.

19. A fabrication method according to claim 1, wherein said predetermined shape of said through hole is substantially circular.

20. A fabrication method according to claim 7, wherein said predetermined shape of each of said through holes is substantially circular.

* * * * *